United States Patent [19]

McDowell

[11] 3,948,278

[45] Apr. 6, 1976

[54] DISPOSABLE ASH RECEPTACLE

[76] Inventor: James A. McDowell, 3706 W. 147th St., Hawthorne, Calif. 90250

[22] Filed: Apr. 7, 1975

[21] Appl. No.: 566,010

[52] U.S. Cl. ..... 131/235 R; 131/241; 220/9 F

[51] Int. Cl.[2] ..... A24F 19/14

[58] Field of Search..... 131/235 R, 236, 237, 241, 131/242, 256; 206/245, 130, 132, 133, 135, 136, 117, 125; 220/9 F, 88 F

[56] References Cited

UNITED STATES PATENTS

| | | | |
|---|---|---|---|
| 2,208,072 | 7/1940 | Griffin | 131/236 |
| 2,319,173 | 5/1943 | Weiss | 131/235 R |
| 2,638,905 | 5/1953 | Morrison | 131/236 |
| 2,657,090 | 10/1953 | Meek | 131/242 X |
| 2,861,577 | 11/1958 | Glasser | 131/235 R |
| 3,568,872 | 3/1971 | Logomasini | 220/9 F |
| 3,804,239 | 4/1974 | O'Brien | 220/9 F X |

*Primary Examiner*—Louis G. Mancene
*Assistant Examiner*—John F. Pitrelli
*Attorney, Agent, or Firm*—Nilsson, Robbins, Dalgarn & Berliner

[57] ABSTRACT

A disposable receptacle for cigarette or cigar ashes is formed of a body of rigid, foamed thermoplastic polymer and a metal shell enclosing the outer bottom and side surfaces thereof. The receptacle includes incense in contact with the body by impregnation or as a surface coating thereon whereby penetration of the body by the lit end of a cigarette or cigar releases incense vapors. Matching pairs of such receptacles can be mated in face-to-face relationship and secured by a girdling adhesive strip. In a further embodiment, the receptacle is contained within a taller housing.

12 Claims, 6 Drawing Figures

DISPOSABLE ASH RECEPTACLE

BACKGROUND AND SUMMARY OF THE INVENTION

A number of methods for the rapid extinguishment of cigarettes or cigars have been proposed, but each has had drawbacks. The usual method is to provide a layer of fine sand in a receptacle into which can be poked the lit end of a cigarette or cigar and which rapidly smothers the lit end. Other methods which have been proposed include devices which provide a reservoir or water into which the entire cigarette can be dropped or a sponge is provided which in turn has contact with a reservoir of water. It will be appreciated that such devices often entail the use of expensive structures and themselves present a cleaning problem. Devices using fine sand must be sifted, and the sand must be periodically replaced. Devices utilizing water to extinguish cigarettes or cigars often become eyesores and, unless often cleaned, generate undesirable odors.

The present invention provides an ash receptacle which overcomes the foregoing drawbacks. The receptacle is formed to rapidly extinguish cigarettes or cigars and is of sufficiently inexpensive construction that it may be simply discarded. Additionally, the present receptacle includes a supply of incense which is vaporized by contact with the lit end of a cigarette or cigar. In particular, the drawbacks of prior devices are avoided and the above advantages are obtained by provision of a disposable receptacle formed of a body of rigid, foamed thermoplastic polymer contained in a metal shell which encloses the bottom and major side surfaces of the body. Preferably, the metal shell is in the form of metal foil closely fitting the polymer body. Incense is included in contact with the body either applied as a layer thereon or impregnated within the polymer material. When in use, one simply pokes the lit end of a cigarette or cigar into the polymer body whereupon it is suffocated and upon contact with the incense results in vaporization thereof to hide any odors resulting from smoking of the cigarette or cigar or from scorching of the polymer. Accordingly, there is provided not only a means for rapidly extinguishing cigarettes and cigars but also a means for hiding odors.

In a further embodiment, a cavity region is formed in the top body surface so as to hold ashes and the like, there being sufficient thickness between the floor of the cavity region and the bottom surface of the body for extinguishment of a cigarette or cigar by the aforesaid penetration.

In still another embodiment, an economical package is provided which is attractive and which provides extended shelf life when a volatile incense component is used. The package comprises a pair of receptacles of like construction with their exposed surfaces in confronting relation and secured together by means of a girdling adhesive strip.

DETAILED DESCRIPTION

Figure 1:
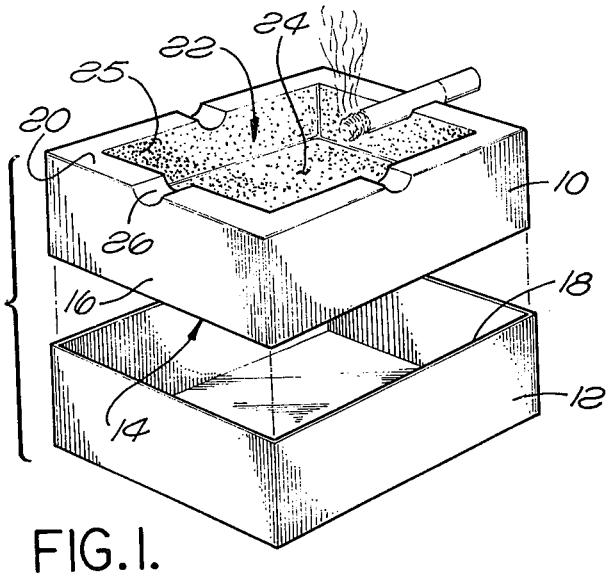
FIG. 1 is an exploded perspective view of a disposable receptacle in accordance with an embodiment of the present invention.
Figure 2:
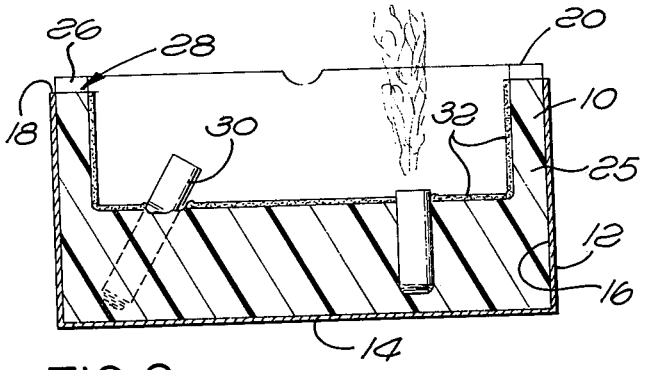
FIG. 2 is a cross-sectional view of the receptacle of FIG. 1, illustrating extinguishment of cigarettes therein.

Referring to FIGS. 1 and 2, there is illustrated a disposable receptacle for cigarette or cigar ashes which is formed of a body 10 of rigid, foamed thermoplastic polymer contained within a metal shell housing 12. The shell housing 12 encloses the bottom surface 14 and major portions of the side surfaces 16 of the polymer body 10. The upper edge 18 of the shell 12 is closely adjacent, but spaced downwardly from the top polymer body surface 20. In further particulars, the top body surface 20 defines a cavity 22 having a floor 24 spaced downwardly therefrom with the result that the top surface 20 constitutes a ridge for the cavity. Depressions 26 are formed in the ridge around the cavity 22 in the usual shape designed for the resting thereon of a cigarette or cigar. In this regard, the top edge of the metal shell 18 can extend up to the lowermost point of the ridge depressions 26, as indicated at 28 in FIG. 2. Of course, the shell can extend further and actually be higher than the polymer foam body, but in such cases, provision should be made for cutaway portion coincident with the ridge depressions 26 to enable cigarettes or cigars to be rested in such depressions.

The manner of usage of the disposable ashtray is particularly illustrated in FIG. 2. Thus, one can poke the lit end of a cigarette 30 against the cavity floor 22 so that the lit end penetrates into the polymer body, as shown. Accordingly, the polymer body should have sufficient thickness between the cavity floor 24 and its bottom surface 14 to permit extinguishment of a cigarette or cigar by penetration. In the particular example illustrated, the polymer body is 2 and ⅛ inches from the bottom surface 14 to the top surface 20 and the thickness between the bottom surface 14 and cavity floor 24 is 1 inch. The cigarette or cigar holding depressions 26 are ⅛ inch deep; therefore, the metal sheel is two inches high. The ridge 25 defined by formation of the cavity 24 is about ¼ inch thick around the cavity 24. Again in a particular embodiment, the polymer body and shell are about 5 inches long and about 3 inches wide.

The metal shell 12 is formed so that its internal dimensions are in substantial conformance with the outer dimensions of the polymer body so as to close-fit the polymer body. In particular, one can choose aluminum foil, tin foil, or the like to define the metal shell, or the shell can be of more rigid material if so desired. It will be appreciated however, that by using metal foil or the like, a very inexpensive ash receptacle is provided.

The polymer body 10 is preferably formed of rigid foamed polystyrene as such material has excellent extinguishment properties. However, other rigid, foamed thermoplastic polymers can be used such as the foamed forms of polyurethane, polyethylene, polypropylene, styrene acrylonitrile copolymer, acrylonitrile-butadiene-styrene terpolymer, chlorinated polyethylene, polyvinylidene chloride, and the like.

In accordance with a further aspect of the present invention, a supply of incense is provided associated with the polymer body. The polymer body can be impregnated with incense by mixing therewith prior to molding or incense can be applied to the surface or surfaces of the body which will be penetrated by the lit cigarette or cigar end. By "incense" is meant any material, such as spices, gums, woods, or the like which produce a fragrant odor when burned. In the embodiment of FIGS. 1 and 2, the incense is applied as a layer 32 coated on the cavity surface by spraying, painting, or the like. Accordingly, when the cigarette 30 is extinguished by poking through the cavity floor 24, and thereby through the incense layer 32, the incense which is burned thereby is volatilized to cover the odor of the burning cigarette and any odor of scorched polymer which may occur.

Figure 3:
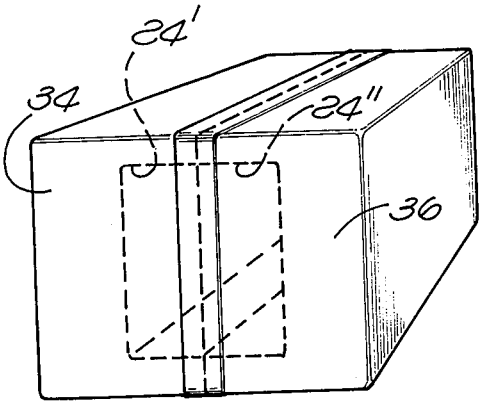
FIG. 3 is a perspective view of the package of two receptacles of like construction arranged in the form of the receptacle of FIG. 1, with depressed ash-receiving cavity regions indicated in shadow.

Referring now to FIG. 3, a further embodiment of the invention is illustrated wherein two ash receptacles 34 and 36, each having the structure of the ash receptacle of FIGS. 1 and 2, are disposed with their top surfaces in contact and with their cavities 24' and 24'' in confronting relation. An adhesive strip, such as adhesive tape, cellophane tape, or the like, is wrapped to girdle the receptacles along the region of contact so as to seal the two receptacles 34 and 36 together. An attractive package is thereby created which also has functional advantages and which provides extended shelf life by sealing the receptacle cavities and thereby preventing loss of volatile components of the incense.

Figure 4:
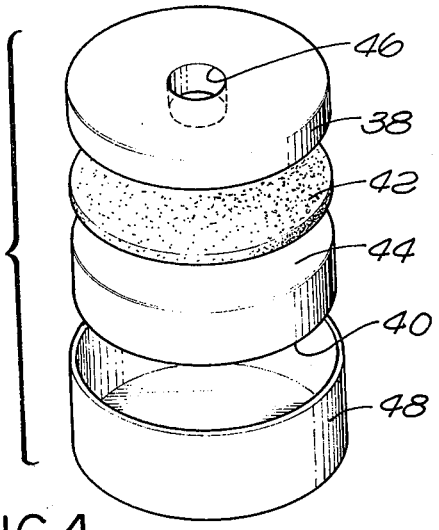
FIG. 4 is an exploded perspective view of an alternative embodiment of the invention in which the polymer body is formed in two parts sandwiching a layer of incense and carried in a metal foil cup.

It will be appreciated that the receptacle described with respect to FIGS. 1 through 3 need not be rectangular, but can have any desired or convenient shape. Referring to FIG. 4, there is illustrated an ash receptacle of cylindrical shape and which is defined by a structure somewhat different than that of the receptacle of FIGS. 1 and 2. In particular, the polymer body is formed in two parts, an upper cylindrical part 38 and a lower cylindrical part 40 which sandwich therebetween a thin layer 42 of incense. The incense is in the form of powder held in a adhesive medium or is in the form of gum or the like and can be applied to the top surface 44 of the lower polymer body 40. The upper polymer body 38 can be formed so as to define a central opening 46 therethrough. The sandwiched members 38, 42 and 40 are disposed within a metal shell 48, which can be metal foil as above described, to provide a simple, inexpensive ashtray receptacle with extended shelf life or volatile incense ingredients as a result of the sandwiching of the incense layer.

Figure 5:
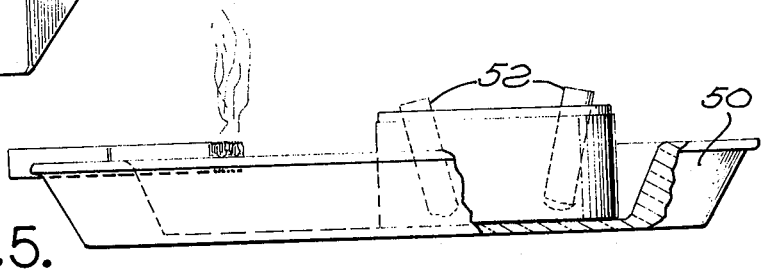
FIG. 5 illustrates an optional means of utilization of the receptacle of FIG. 1 or of FIG. 4.

Referring to FIG. 5, the receptacle of FIG. 4 is shown in use and it can be conveniently used by placement within an ashtray 50 of standard configuration, as shown. As indicated by the cigarette butts 52, the receptacle of FIGS. 4 and 5 is used by simply poking the lit end of a cigarette or cigar into the top surface whereupon it penetrates through to contact the incense layer 42, and penetrates past the incense layer 42 into the bottom polymer body 40. Alternatively, one can place a cigarette or cigar into the opening 46 for direct contact with the incense layer, or one can drop a match into the opening 46 to ignite the incense layer if it is desired to burn the incense without extinguishing a cigarette.

Figure 6:
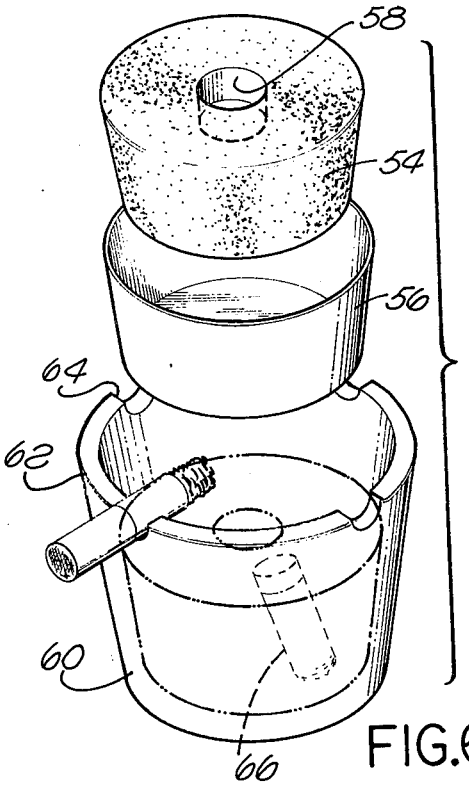
FIG. 6 is an exploded, perspective view of an alternative embodiment of the invention in which a polymer body and shell therefor are enclosed within a taller ash-tray housing.

Referring to FIG. 6, still another embodiment is illustrated wherein a solid body 54 of thermoplastic polymer as above described is provided in the shape of a truncated cone and is disposed in a cup-like metal shell 56 of like configuration. The polymer body can have a cavity 58 formed through the top surface and extending into the body for receiving the lit end of a cigarette, cigar or the like. In this embodiment, the polymer body 54 is impregnated with liquid incense; alternatively, the molten polymer is mixed with solid incense powders during molding of the body 54.

The polymer body 54 with its metal housing 56 is dropped as an insert into a larger receptacle 60, also in the form of a hollow truncated cone. The larger receptacle 60 has a lower portion which is formed with internal dimensions which are in substantial conformance with the outer dimensions of the shell 56 so as to enclose the shell 56. The larger receptacle 60 also has an upper portion which continues upwardly from the lower portion to form a top edge 62 which is notched therearound, as at 64, to provide a resting surface for a cigarette or cigar.

During use, as indicated in shadow at 66, a cigarette or cigar is extinguished by poking the lit end thereof into the incense-impregnated polymer body 54 resulting concurrently in volatilization of a portion of the incense to hide the odors of the burning cigarette or cigar and/or scorched polymer.

Variations in the foregoing embodiments can be made in accordance with desired design characteristics and all such variations are intended to be covered to the extent that they are defined by the claims appended hereto.

I claim:

1. A disposable receptacle for cigarette or cigar ashes, comprising:

a body formed of rigid, foamed thermoplastic polymer and having bottom, side and top surfaces, said body having at least a top surface portion exposed for extinguishment by penetration of the lit end of said cigarette or cigar; incense in contact with said body for release of incense vapors upon contact by said lit cigarette or cigar end, said top body surface defines a cavity having a floor spaced downwardly therefrom for holding of cigarettes or cigar ashes or the like, said body having sufficient thickness between said cavity floor and said bottom surface for said extinguishment by penetration and a metal shell housing said body and formed with an internal dimension in substantial conformance with the outer dimensions of said body to enclose said bottom surface and major side surface portions of said body.

2. The receptacle of claim 1 wherein said incense is carried by said top surface portion.

3. The receptacle of claim 1 wherein said metal shell comprises metal foil, and wherein the upper edge of said shell is adjacent, but spaced downwardly from, said top body surface for exposure of an edge of said body.

4. The receptacle of claim 1 including a second receptacle of like construction and including means for releasably securing said receptacles together with the top body surface of said second receptacle in confronting relation to the top body surface of said first-mentioned receptacle.

5. The receptacle of claim 4 wherein said securing means comprises an adhesive strip girdling said receptacles along the region of said contact.

6. The receptacle of claim 3 including a second receptacle of like construction, and including means for releasably securing said receptacles together with the top body surface of said second receptacle in contact with the top body surface of said first-mentioned receptacle.

7. The receptacle of claim 6 wherein said securing means comprises an adhesive strip girdling said receptacles along the region of said contact.

8. The receptacle of claim 7 wherein the top body surface of each said receptacle defines a cavity having the floor spaced downwardly therefrom for holding of cigarette or cigar ashes or the like, each said body having sufficient thickness between said cavity floor and the bottom surface of said body for extinguishment by penetration, said cavity floors carrying incense thereon for release of the incense vapors upon contact by said lit cigarette or cigar end.

9. The receptacle of claim 1 wherein said incense is impregnated through said polymer body.

10. The receptacle of claim 1 wherein said body is sufficiently thin from top to bottom to enable penetration therethrough of a lit cigarette or cigar end and wherein said incense constitutes at least a portion of layer below and in contact with at least a portion of said bottom surface.

11. The receptacle of claim 10 including a body of rigid, foamed thermoplastic polymer below and in contact with said incense layer.

12. The receptacle of claim 1 including a tray housing said shell, said tray having a lower portion formed with internal dimensions in substantial conformance with the outer dimensions of said shell to enclose said shell and having an upper portion continuing upwardly therefrom.

* * * * *